US005918563A

United States Patent [19]

Kaster et al.

[11] Patent Number: 5,918,563

[45] **Date of Patent: *Jul. 6, 1999**

[54] POSITIONING SYSTEM WITH DIFFERENTIATED COMPLIANT ANCHORING

[75] Inventors: Fernando Gulherme Castanheira Kaster, Pelotas; Mauricio Sebastião Sampaio de Barros, Petrópolis, both of Brazil

[73] Assignee: Petroleo Brasileiro S.A., Petrobras, Rio De Janeiro, Brazil

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,674

[22] Filed: Dec. 19, 1996

[30] Foreign Application Priority Data

Dec. 22, 1995 [BR] Brazil ..... 9506067

[51] Int. Cl.[6] ..... B63B 21/24

[52] U.S. Cl. ..... 114/293; 114/230

[58] Field of Search ..... 441/3–5; 114/230, 114/293; 405/224

[56] References Cited

U.S. PATENT DOCUMENTS

| | | | |
|---|---|---|---|
| 2,919,671 | 1/1960 | Knapp et al. | 114/230 |
| 4,941,776 | 7/1990 | Bosgiraud et al. | 114/293 |
| 5,061,131 | 10/1991 | Petty et al. . | |
| 5,159,891 | 11/1992 | Lohr et al. | 114/293 |

FOREIGN PATENT DOCUMENTS

WO8806999 3/1988 WIPO .

*Primary Examiner*—Jesus D. Sotelo
*Attorney, Agent, or Firm*—Sughrue, Mion, Zinn, Macpeak & Seas, PLLC

[57] ABSTRACT

The invention relates to a positioning system using anchoring of the ship which allows it to move in order better to accommodate variations in the environment, avoiding fully parallel situations (in which the ship is fully head on to the weather) and the situation in which it is fully crosswise (arthwart to the weather), based on the distribution and setting-up of mooring lines which define differentiated degrees of rigidity (compliance) in the anchoring system.

2 Claims, 4 Drawing Sheets

POSITIONING SYSTEM WITH DIFFERENTIATED COMPLIANT ANCHORING

FIELD OF THE INVENTION

Owing to the discovery of oil-producing fields in increasingly deep water, it has become necessary to develop production systems capable of operating efficiently at these new water depths and with low installation and maintenance costs.

The present invention applies to ocean terminals wherever an oil tanker may need to be positioned in order to receive production from offshore oil fields.

The positioning system of the present invention allows the oil tanker, anchored according to the concept proposed herein, to move in order better to accommodate variations in the environment.

PRIOR ART

Ocean terminals operating in Brazil today are responsible for discharging 30% of national oil production. In the best-known production system, three principal types of ocean terminals are used; namely:—a buoy frame, a monobuoy and an anchoring frame.

With the buoy-frame system, a petroleum vessel (tanker) is moored by means of cables to 6 or 7 buoys which are anchored to the sea bed. This ship receives the oil produced on the platform, through floating flexible piping. Since the system operates offshore, it is subject to environmental conditions, which requires that safety regulations be rigorously observed. For example, the ship and the platform must be positioned side-by-side in relation to the ocean currents so that if the hawsers of one of them break the ship does not collide with the platform or vice-versa.

When this petroleum vessel is full, a second (relief) boat is moored alongside the first, to two of its mooring buoys, and is kept in position by two tugboats, while the oil contained in the first oil tanker is transferred to the relief boat through flexible piping connecting the two vessel.

The drawback of this system is that the piping transferring and/or discharging the production oil is subject to environmental conditions, since both the ship and the platform are generally severely affected by very bad sea conditions. Consequently, the ship drifts a great deal, which makes it essential to use floating flexible piping capable of moving with the ship when it is offset from its initial position.

A further drawback is that, if this piping breaks, all the oil will be spilled into the sea. Besides the financial loss caused by the stoppage in production, serious environmental damage may occur.

The monobuoy-type system consists of a floating cylindrical body anchored to the sea bed by 6–8 mooring lines, this cylindrical body comprising a fixed lower part where the production line (riser) arrives, and a movable upper part where there is a turntable. The petroleum vessel is moored to this cylindrical body by means of cables. The turntable is provided with a system of bearings which allows the ship, even while moored to the monobuoy, to turn through 360° around the monobuoy.

The underwater lines from the platforms arrive at the ship via the sea bed, from which rises a flexible line (riser) supported by a buoy connected hermetically to the monobuoy. In the monobuoy there is a "swivel" device which converts axial (vertical) flow into radial (horizontal) flow, allowing production to be discharged to the ship. This transfer is carried out with the aid of a flexible hose.

The drawback of this system is that the swivel which is responsible for the hermetic sealing of the flow is very expensive to maintain since it requires production to be able to be stopped in the event of a breakdown so that the swivel can be replaced.

The anchoring-frame system is considered to be an improvement over the buoy-frame system since in this case the ship is itself anchored to the sea bed. The advantage of this system is that the ship is better secured and the risk of an offset is therefore reduced, thus making it possible for an underwater line to reach the ship. Even so, the influence of sea conditions is quite substantial.

More recently a system known as the "turret" system has been developed in which a monobuoy is mounted in the tanker, the monobuoy possessing various levels of concentric seals and working at high pressures. This system also makes it possible for the ship to turn through 360° but, because of the complexity of the system, the tanker would have to be brought into dry dock in the event of a breakdown or damage to the monobuoy.

OBJECT OF THE INVENTION

It is an object of the present invention to provide a system which solves the problems mentioned above with efficiency, a low initial cost, safety, a simplified installation, and reduced maintenance and high reliability.

It is another object of the present invention to provide a positioning system using anchoring of the ship, based on the distribution and setting-up of mooring lines which define differentiated degrees of rigidity in the anchoring system. The system should allow the ship to move in order better to accommodate variations in the environment, avoiding fully parallel situations (head on to the weather) and the situation in which it is fully crosswise (athwart to the weather).

SUMMARY OF THE INVENTION

According to the present invention there is provided a positioning system using anchoring with differentiated compliance (as herein defined), consisting of a platform, or other recovery means, and a petroleum vessel into which it is intended to discharge the production of and offshore oilfield, said positioning system being characterized in that the tanker is anchored so that the mooring lines comprise chains and/or cables; and in that the elasticity and/or geometry of the lines is varied so as to allow the ends of the ship to move so that it can accommodate variations in sea conditions.

DETAILED DESCRIPTION OF THE INVENTION

Figure 1A:
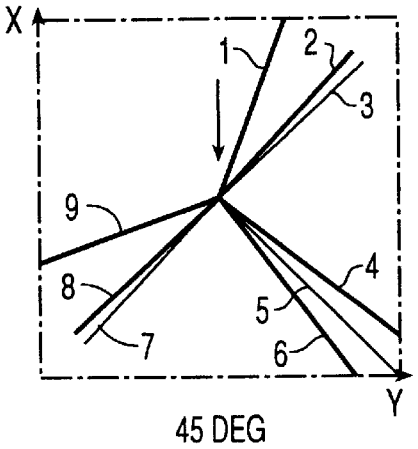
FIGS. 1*a*–1*e* are schematic illustrations of a vessel and mooring lines for small yaw waves at different angels under simulated conditions.
Figure 1B:
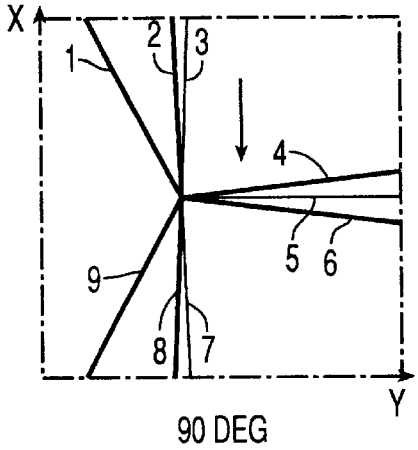
Figure 1C:
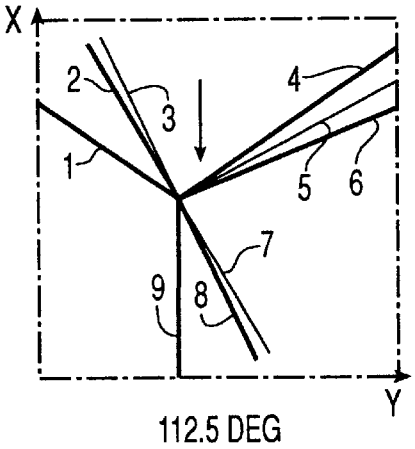
Figure 1D:
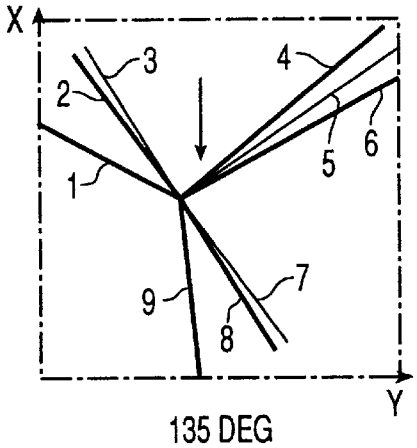
Figure 1E:
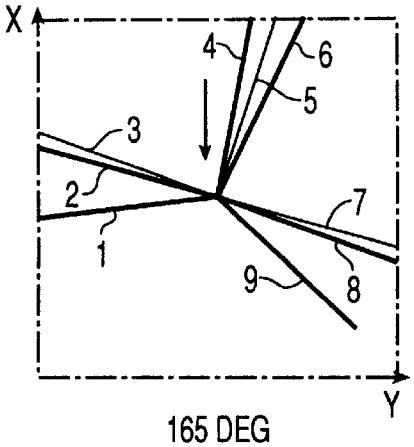
Figure 2A:
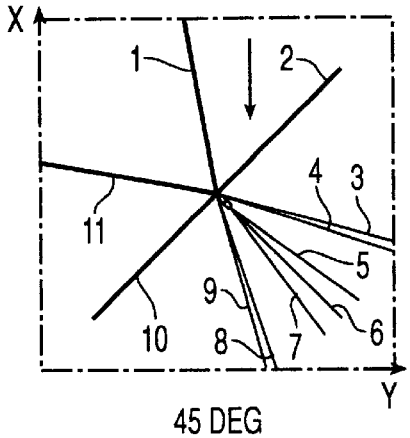
FIGS. 2A–2E and 2G are schematic illustrations of a vessel and mooring lines for large yaw waves at different angles under simulated conditions.
Figure 2B:
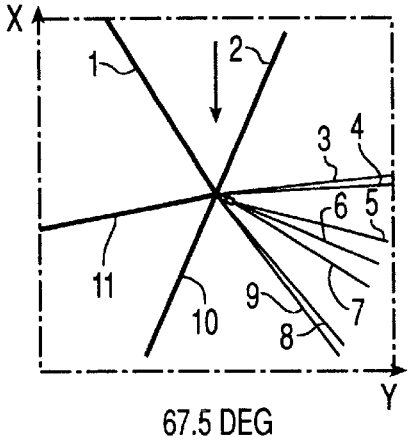
Figure 2C:
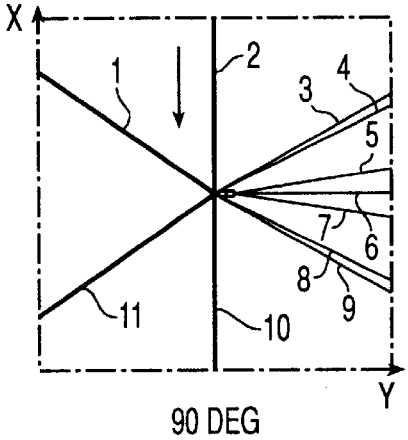
Figure 2D:
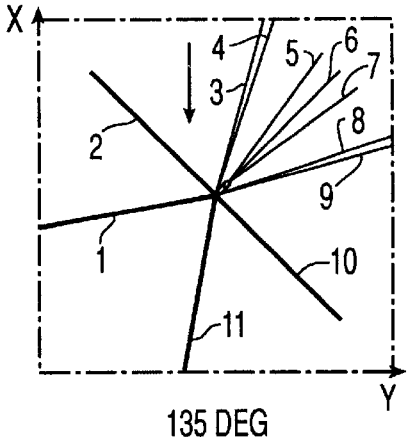
Figure 2E:
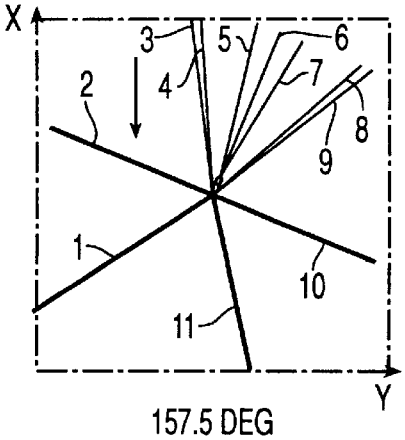
Figure 2G:
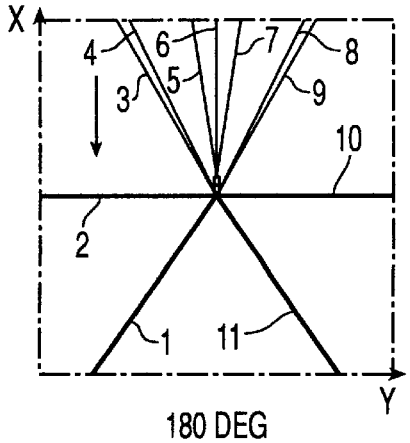

The present invention is based on a novel concept, which we refer to herein as differentiated compliance, (developed from parametric studies using commercially available software and which has been consolidated in full-scale trials).

In the present study, trials were conducted at Campo de Caravela, located in the Santos Basin (Brazil), with a water depth of approximately 200 meters. As regards safety, all the regulations required when operating with a buoy-frame system were observed, with only one "off station" incident probable per year due to adverse weather conditions.

It was confirmed in practice that anchoring lines comprising a mixed system (chains alternating with steel wires or cables) give the system greater rigidity than anchoring lines comprising only chains. This means that, if the same tension is applied to these lines, a line comprising a mixed system of chains and cables will be displaced horizontally over a shorter distance than a line comprising only chains, even though the chain lines are heavier.

On the basis of this observation, the ship positioning system according to the present invention comprises the provision of anchoring lines consisting of a mixed system of chains and cables.

The immediate consequence of using this system is that the ship is able to "accommodate" variations in sea conditions. Because one of the ends of the ship is thus able to move, the ship can turn sufficiently to accommodate new sea conditions and is not drawn out of position by the sea. The degree of freedom of movement is a function of the combined effort of its anchoring lines, and of varying the elasticity and/or geometry of its anchoring lines.

Various tests were planned to study the behaviour of the presently proposed mooring system when subjected to adverse environmental conditions, such as wind, waves and ocean currents, and to evaluate the stresses produced in these mooring lines.

To select the tests, a numerical simulation was performed with the aim of establishing the most suitable coefficients for use in computer programs so as to allow extrapolation and prediction of the behaviour of the proposed system under different environmental conditions, at different depths of water, and with different types of vessel.

The modelling data were obtained from tests performed in a test tank measuring 80 meters long by 50 meters wide, with variable depth, adjustable from 0 to 9 meters, the tank also being provided with means for simulating waves of various types, amplitudes and directions, as well as simulating winds and current channels of various types.

Water depths in the range 190 to 1000 meters were simulated in the tests, with scale models of vessels having the correct ballast and weight distribution to obtain the correct mass, centre of gravity, and turning radius appropriate for the loading conditions established.

The modelling of the mooring lines, obeying standardized procedural criteria for this type of system, took the following parameters into account:

(a) depth of water;

(b) length and configuration of the mooring lines;

(c) weight of the submerged line per unit length;

(d) mechanical elasticity of the lines;

(e) dragging force of the lines per unit length;

(f) coefficient of friction over the sea bed;

(g) level of pre-tensioning in the line.

Various configurations of mooring lines were tested with differentiated levelling between stern and bow. These tests were able to confirm the influence of variation of the water depth on the mooring system, showing that, even if the mooring line is damaged, the variation in transient motion observed is small owing to the small amount of damping offered by the system.

The majority of the tests were performed so that the hundred-year wave reached the vessel under the most adverse conditions (between 90 and 180 degrees).

Under the test conditions established, it was observed that horizontal offsets of the area where the risers are connected to the vessel were less than 25% of the depth of water, and the maximum tension in the line did not exceed 75% of breaking load. This proves that, for the criteria of displacement and stress, the system is viable and satisfactory.

The following tables show some of the results of the trials performed. All the tests were performed under hundred-year wave conditions, with variations in the depth of the water, the type of vessel, and the configuration of the mooring lines.

TABLE (1)

| Depth (m) | | 195 | 300 | 500 | 700 | 1000 |
|---|---|---|---|---|---|---|
| Type of vessel | 28000 | X | | | | |
| (tonnes) | 135000 | X | X | X | X | X |
| Configuration | single | 8 | | | | |
| (no. of lines) | double | | 8 | | | |
| | mixed (*) | | | 16 | 16 | 16 |

(*) system consisting of chain + cable + chain

The influence of various types of wave on the configurations adopted for the mooring lines was also studied. Breakage or damage to the line was also simulated, as was offset of the point of connection of the ship to the production lines (risers) already installed.

In the first battery of tests the vessel had a displacement of 135000 tonnes, 300 meters in height.

For small yaw waves, various tests covered the use of 15 mooring lines of which 6 were double and 3 single, grouped into three sectors each containing 5 lines (FIG. 1). Thicker lines 1, 2, 4, 6, 8 and 9 are double lines and thinner lines 3, 5 and 7 are single lines.

For large yaw waves tests covered the use of 15 mooring lines of which 4 were double and 7 single, with 6 pairs on the bow with a 60 degree spacing between the lines of a pair (FIG. 2). Thicker lines 1, 2, 10 and 11 are double lines and thinner lines 3–9 are single lines.

Figure 3A:
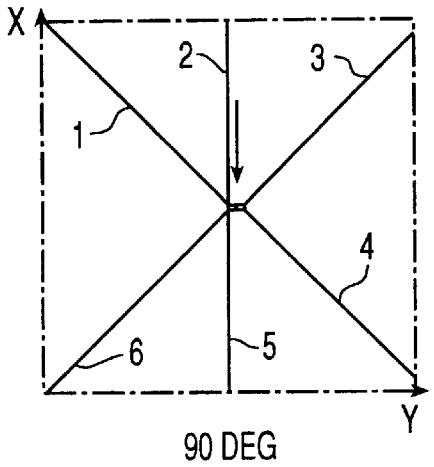
FIGS. 3A and 3B are schematic illustration of a vessel and mooring lines without simulation.
Figure 3B:
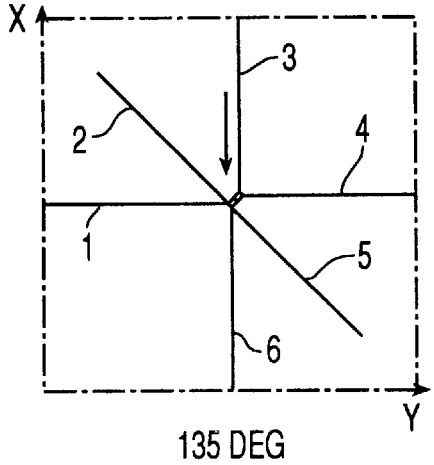
Figure 4:
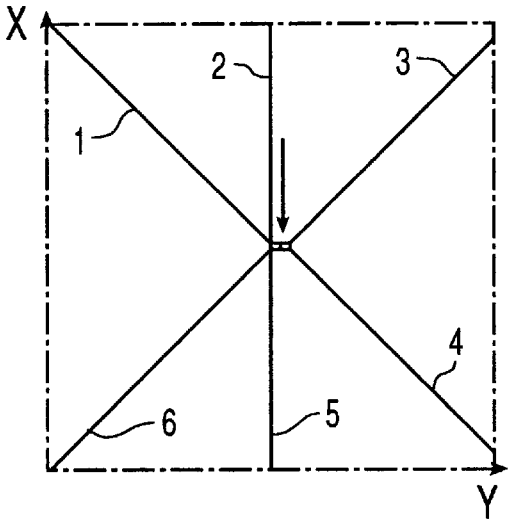
FIG. 4 is a schematic illustration of a mooring system for greater depths.
Figure 5A:
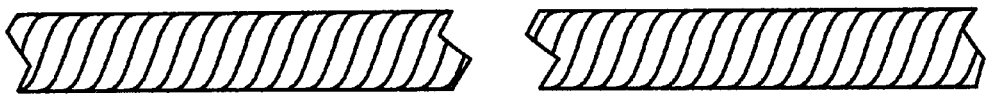
FIG. 5A shows a mooring line comprised solely of length of cable.
Figure 5B:
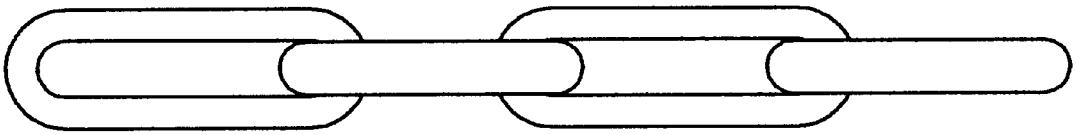
FIG. 5B shows a mooring line comprised solely of lengths of chain.
Figure 5C:
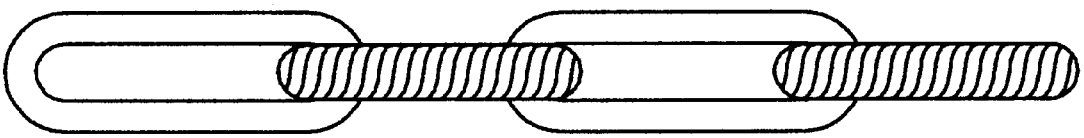
FIG. 5C shows a mooring line comprised of alternate lengths of chain and cable.

In the second battery of tests, a test without computer simulation was performed with the aim of obtaining information for the proposed anchoring system. The tests used a system of six points with double lines; with 2 lines on the bow at 90° and 270° with pre-tension T, and 4 lines on the stern at 45°, 135°, 225° and 315°, all with the same pre-tension T'. The tensions T and T' were varied during the tests (FIG. 3). Similar systems were also tested for vessels with displacements of 280000 tonnes and water depths of 390 and 700 meters, with large yaw and small yaw waves (FIG. 4), and for the larger depths the mooring system was configured with 15 lines, of which 6 were double and 3 single.

The great advantage of this system is that, by simply applying this concept, a reduction in investment costs of approximately 30% can be achieved.

Having taken account of the depth of the water and the tonnage of the ship, the system can advantageously replace other established systems, such as the anchoring frame, monobuoy and even the turret, since it does not require the use of a swivel, thereby also drastically reducing maintenance costs and offering the advantage of using a less complex system.

A further advantage is that this novel concept involves the application of all the materials and operating methods used world-wide for established systems, and the usual criteria such as safety and operating standards, which removes the need to use new tools.

Like all the conventional systems, the system now proposed also has limitations. Its applicability will be determined by a technical and economic viability study specific to the location, in which water depth and the tonnage of the tanker will be the principal variables.

Bearing in mind that the tonnage of the ship is dictated by the production capacity of the field, and the water depth is that of the location of the field, we can state with certainty on the basis of our experimental studies, and with the aid of properly checked software, whether the anchoring system with differentiated compliance may or may not be applied in each specific case.

Our studies indicate that compliance differentiation works better the deeper the water, i.e. the greater the chances of stern/bow displacement of the ship, which makes this system a highly competitive alternative both technically and economically.

We claim:

1. A positioning system for a vessel using anchoring with differentiated compliance for allowing the ends of the vessel to perform different motions to accommodate variations in sea conditions, the system comprising the vessel adapted to receive production from an offshore oil field from a platform and a plurality of mooring lines connected to opposite ends of the vessel, wherein at least one of said lines comprises alternate links of chain and cable, said positioning system allowing the ends of the vessel to move wherein the length, elasticity and geometric arrangement of the mooring lines are selected according to environmental conditions, depth of the water where the system will be installed, vessel tonnage and allowed movement of the opposite ends of the vessel, wherein a plurality of said mooring lines are comprised of lengths of chain only.

2. A positioning system for a vessel using anchoring with differentiated compliance for allowing the ends of the vessel to perform different motions to accommodate variations in sea conditions, the system comprising the vessel adapted to receive production from an offshore oil field from a platform and a plurality of mooring lines connected to opposite ends of the vessel, wherein at least one of said lines comprises alternate links of chain and cable, said positioning system allowing the ends of the vessel to move wherein the length, elasticity and geometric arrangement of the mooring lines are selected according to environmental conditions, depth of the water where the system will be installed, vessel tonnage and allowed movement of the opposite ends of the vessel, wherein a plurality of said mooring lines are comprised of lengths of cable only.

* * * * *